US008144885B2

(12) United States Patent
Pan

(10) Patent No.: US 8,144,885 B2
(45) Date of Patent: Mar. 27, 2012

(54) SOUND INSULATING DEVICE

(75) Inventor: Chiang-Fu Pan, Taipei County (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 603 days.

(21) Appl. No.: 12/394,236

(22) Filed: Feb. 27, 2009

(65) Prior Publication Data

US 2010/0054487 A1 Mar. 4, 2010

(30) Foreign Application Priority Data

Aug. 29, 2008 (CN) ..... 2008 1 0304282

(51) Int. Cl.
*H04R 29/00* (2006.01)

(52) U.S. Cl. ..... 381/60; 381/59; 381/354

(58) Field of Classification Search ..... 381/59, 381/60, 353, 354, 124, 55, 393, 394, 395
See application file for complete search history.

(56) References Cited

U.S. PATENT DOCUMENTS 3,876,035 A * 4/1975 Eckel ..... 181/198
4,065,647 A * 12/1977 Frye et al. ..... 381/60
4,805,728 A * 2/1989 Carter et al. ..... 181/141
6,604,603 B1 * 8/2003 Wirth ..... 181/200

* cited by examiner

*Primary Examiner* — Victor A Mandala
*Assistant Examiner* — Scott Stowe
(74) *Attorney, Agent, or Firm* — Altis Law Group, Inc.

(57) ABSTRACT

A sound insulating device used to carry out audio testing of a mobile phone is provided. The sound insulating device includes a sound speaker, a sound receiver, a clamping platform clamping the mobile phone thereon and a sound insulating chamber. The sound insulating chamber receives the sound speaker and the sound receiver and the clamping platform therein. The sound insulating chamber is enclosed by several sound insulating boards. Each sound insulating board includes a sound absorbing layer, a cushion layer and an aluminium-alloy layer combined together. The cushion layer is sandwiched between the absorbing layer and the aluminium-alloy layer.

8 Claims, 6 Drawing Sheets

SOUND INSULATING DEVICE

BACKGROUND

1. Field of the Invention

The present invention relates to sound insulating devices, and particularly, to a sound insulating device used in audio testing.

2. Description of Related Art

Audio testing is typically necessary for the manufacturing of electronic devices incorporating audio components (such as earphones or speakers).

Audio testing can be implemented by a computer. The computer works to run its installed software to send series of commands to a testing platform to test audio quality of the audio component. The testing result of the testing platform may be fed back to the computer for further audio quality grading. However, audio testing is usually implemented in a noisy environment. Various kinds of noises tend to degrade the testing accuracy of the audio component of the electronic device.

Therefore, there is room for improvement within the art.

BRIEF DESCRIPTION OF THE DRAWINGS

Many aspects of the sound insulating device can be better understood with reference to the following drawings. These drawings are not necessarily drawn to scale, the emphasis instead being placed upon clearly illustrating the principles of the present sound insulating device. Moreover, in the drawings like reference numerals designate corresponding sections throughout the several views.

DETAILED DESCRIPTION OF EXEMPLARY EMBODIMENT

Figure 1:
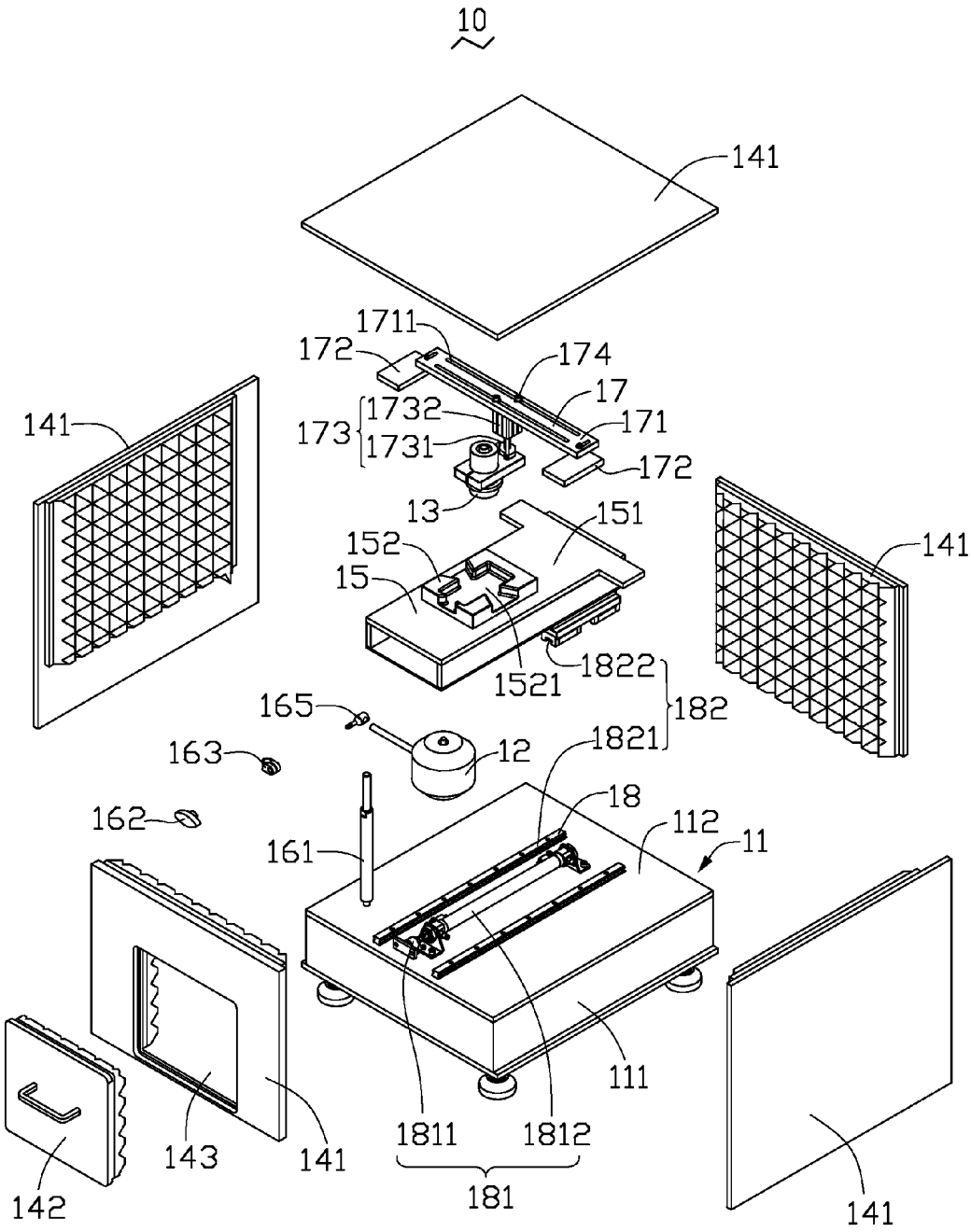
FIG. 1 is an exploded, isometric view of a sound insulating device, in accordance with an exemplary embodiment.

FIG. 1 shows an exemplary sound insulating device 10 used in testing audio components of the portable electronic devices, such as mobile phone terminals, digital cameras, and etc. The sound insulating device 10 includes a base member 11, an air supply (not shown), a sound speaker 12, a sound receiver 13, a sound insulating chamber 14 (see FIG. 5), a clamping platform 15, a sound speaker position adjusting mechanism 16 (see FIG. 4), a sound receiver position adjusting mechanism 17 and a clamping platform adjusting mechanism 18. The sound speaker 12, the sound receiver 13, the sound insulating chamber 14, the clamping platform 15, the sound speaker position adjusting mechanism 16, the sound receiver position adjusting mechanism 17 and the clamping platform adjusting mechanism 18 are mounted on the base member 11.

The base member 11 includes sidewalls 111 and a substantially planar working panel 112.

The sound speaker 12 is used to generate the sound of human speech. The sound receiver 13 is used to receive the sound generated from the sound speaker 12. The sound speaker 12 and the sound receiver 13 are electronically connected to a testing circuit board (not shown).

Figure 2:
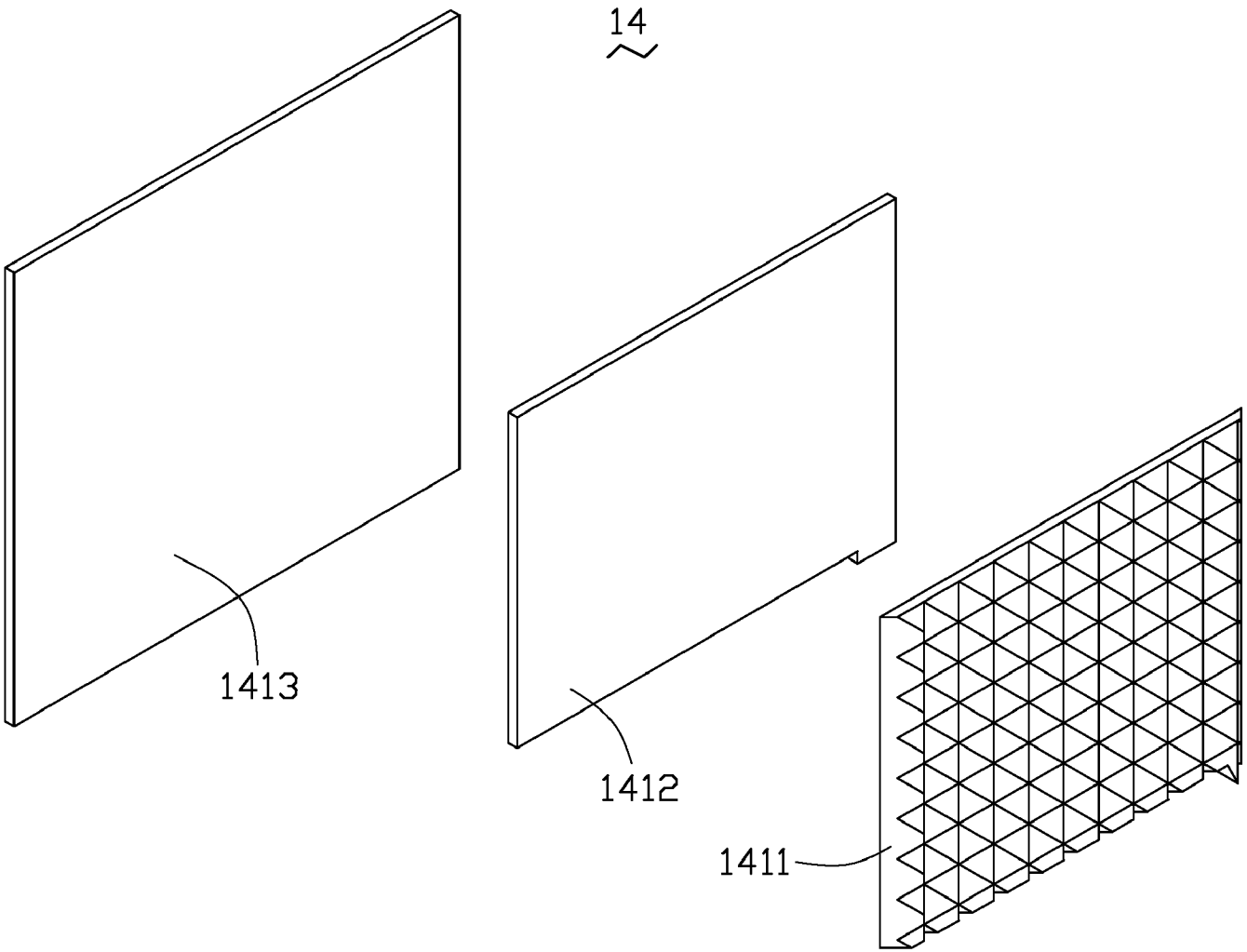
FIG. 2 is an exploded, isometric view of the insulating board shown in FIG. 1.

FIG. 1 shows five sound insulating boards 141 and one sound insulating door 142. The sound insulating boards 141 and the sound insulating door 142 enclose the sound insulating chamber 14. FIG. 2 shows each sound insulating board 141 or the sound insulating door 142 including a sound absorbing layer 1411, a cushion layer 1412 and an aluminium-alloy layer 1413. The cushion layer 1412 is sandwiched between the sound absorbing layer 1411 and the aluminium-alloy layer 1413. The sound absorbing layer 1411, the cushion layer 1412 and the aluminium-alloy layer 1413 are integrally formed (e.g., adhered) as a unit. The sound absorbing layer 1411 ranges from about 15 mm to about 25 mm in thickness. The cushion layer 1412 ranges from about 5 mm to about 15 mm in thickness. The aluminium-alloy layer 1413 ranges from about 15 mm to about 25 mm in thickness. The sound absorbing layer 1411 may be made of foam and has a sound absorbing shape as known in the art, e.g. generally zigzag. The cushion layer 1412 may be made of polystyrene (PS). One sound insulating board 141 defines a rectangular hole 143 configured to allow the clamping platform 15 to pass through. The sound insulating door 142 is configured to close off the hole 143. The sound insulating door 142 can be linearly fixed to the clamping platform 15.

Referring to FIG. 1, the clamping platform 15 includes a clamping board 151 and a positioning base 152. The positioning base 152 defines a positioning cavity 1521 to position the portable electronic device therein. The positioning base 152 can be fixed (e.g., welded or screwed) to the clamping boards 151.

Figure 3:
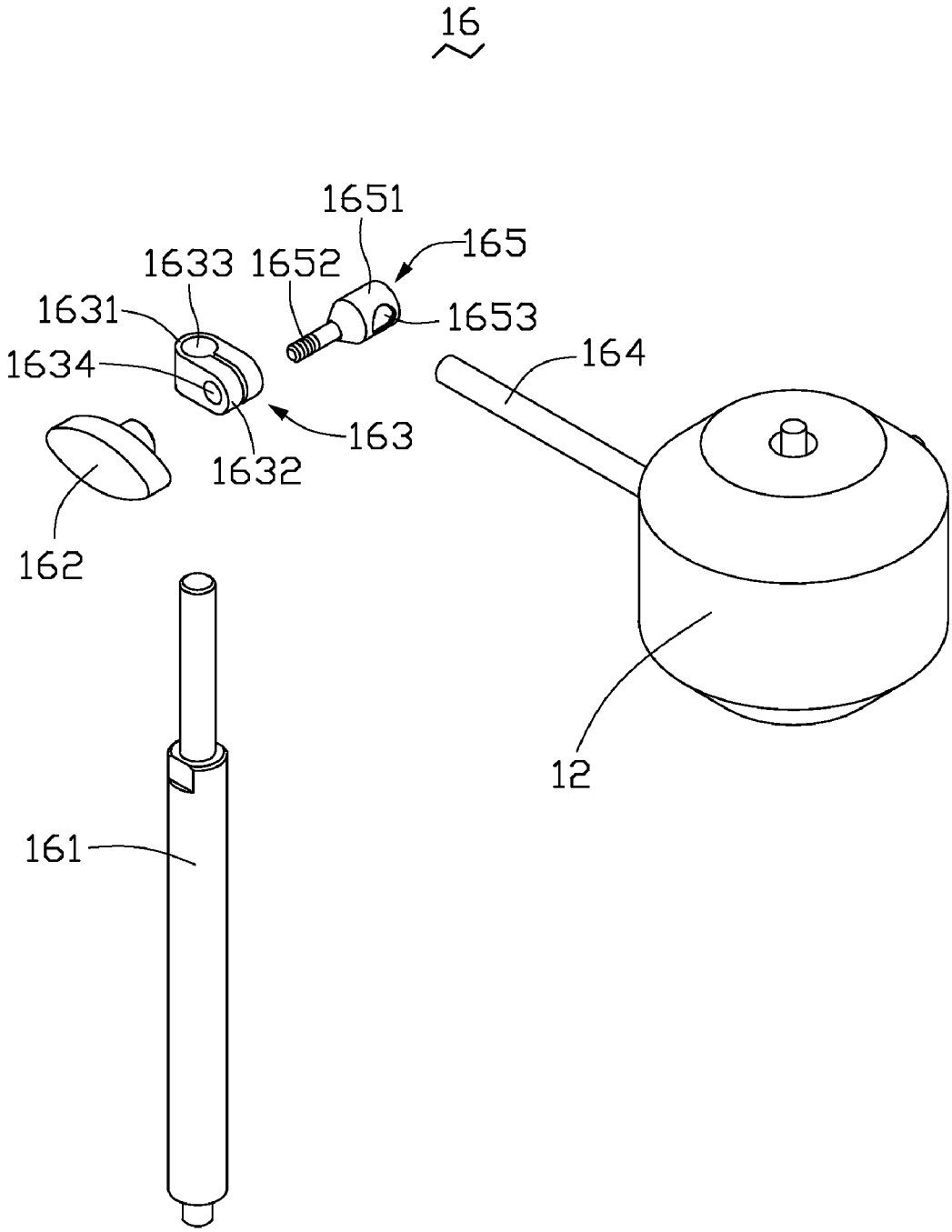
FIG. 3 is an exploded, isometric view of the sound speaker position adjusting mechanism shown in FIG. 1.

Referring to FIG. 3, the sound speaker position adjusting mechanism 16 includes a sliding bar 161, an adjusting cap 162, a U-shaped elastic member 163, a connecting pole 164 and a screw 165. The sliding bar 161 is fixed to the working panel 112. The adjusting cap 162 defines a screw hole (not shown). The screw 165 forms a connecting head 1651 at one end, and defines a threaded portion 1652 at the other end. The connecting head 1651 defines a connecting hole 1653. The U-shaped elastic member 163 includes a body portion 1631 and two arm portions 1632 extending from two sides of the body portion 1631. The U-shaped elastic member 163 defines a sliding hole 1633 configured to slidably receive the sliding bar 161. The arm portions 1632 define two co-axial holes 1634 therethrough. The threaded portion 1652 of the screw 165 can pass through the holes 1634 to linearly engage into the screw hole of the screw cap 162, thereby positioning (e.g. by clamping) the elastic member 163 on the sliding bar 161. The connecting pole 164 is formed on the sound speaker 12 and slidingly engages into the connecting hole 1653. When the connecting pole 164 is made to slide along the connecting hole 1653, the position of the sound speaker 12 along the connecting hole 1653 can be adjusted. When the adjusting cap 162 is regulated to release the U-shaped elastic member 163, the U-shaped elastic member 163 can slide up and down along the the sliding bar 161 and rotate about the sliding bar 161. Therefore, the sound speaker position adjusting mechanism 16 can efficiently adjust the height and angular position of the sound speaker 12.

Figure 4:
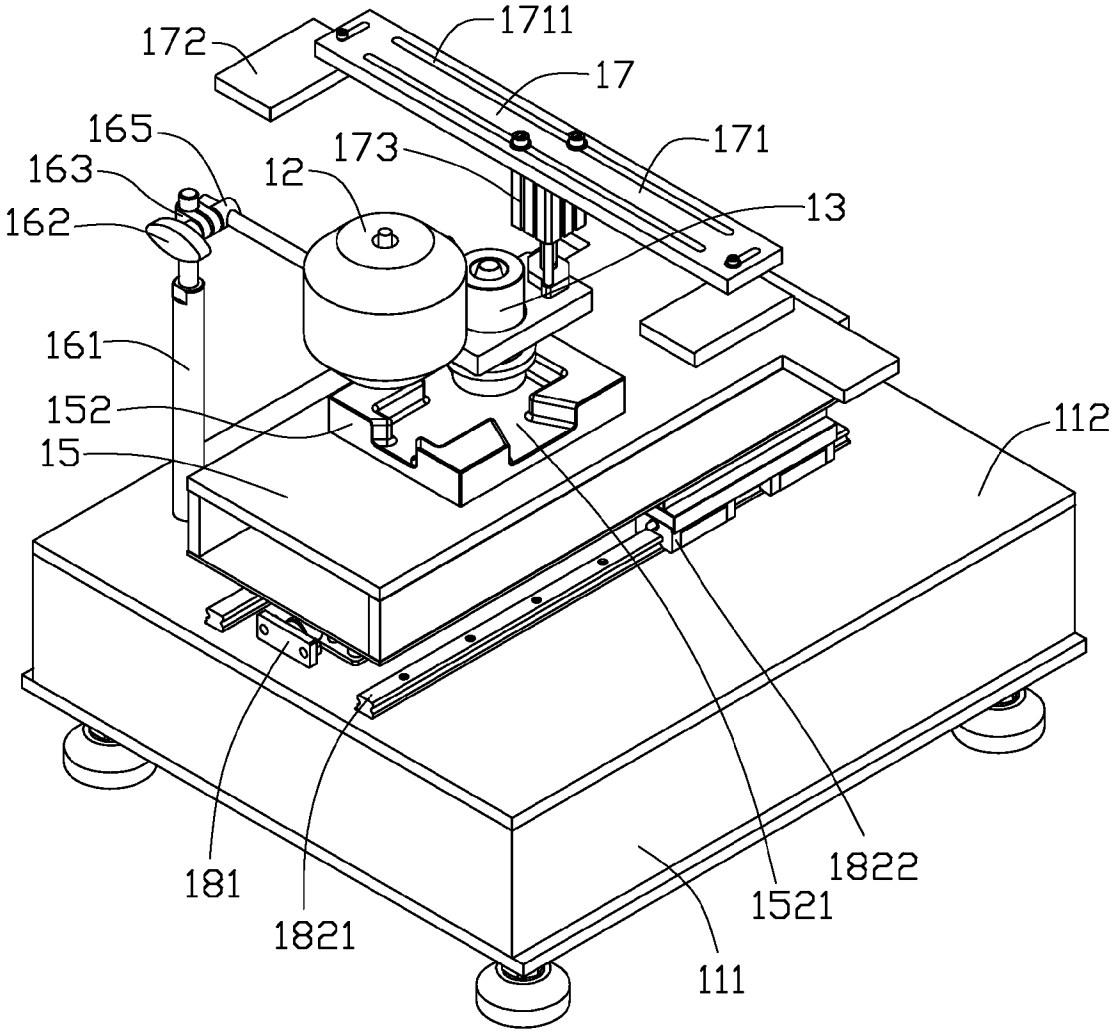
FIG. 4 is an isometric, partially assembled view of the sound insulating device shown in FIG. 1.

Referring to FIGS. 1 and 4, the sound receiver position adjusting mechanism 17 includes a sliding board 171, two positioning boards 172, and a first air cylinder 173 connected to the air supply. The sliding board 171 defines two parallel sliding slots 1711. The first air cylinder 173 includes a first shaft 1731 and a first body 1732. The first shaft 1731 is slidably accommodated in the first body 1732 and fixed to the sound receiver 13. The first body 1732 is slidably attached to the sliding board 171 along the sliding slots 1711. When the first body 1732 is made to slide along the sliding slots 1711, the position of the sound receiver 13 along the sliding slots 1711 can be adjusted. When the first shaft 1731 is driven to back and forth in the first body 1732, the position of the sound receiver 13 perpendicular with the sliding slots 1711 can be adjusted. Therefore, the sound receiver position adjusting mechanism 17 can efficiently adjust the position of the sound receiver 13.

Referring to FIG. 1, the clamping platform adjusting mechanism 18 includes a second air cylinder 181 connecting the air supply and a sliding mechanism 182. The second air cylinder 181 includes a second shaft 1811 and a second body 1812. The second shaft 1811 is slidably accommodated in the second body 1812 and fixed to the clamping platform 15. The second body 1812 is secured on the working panel 112. The sliding mechanism 182 includes two parallel rails 1821 and two guiding slots 1822 corresponding to the rails 1821 defined in the body portion 151. The rails 1821 can slidably engage along the guiding slots 1822.

Figure 5:
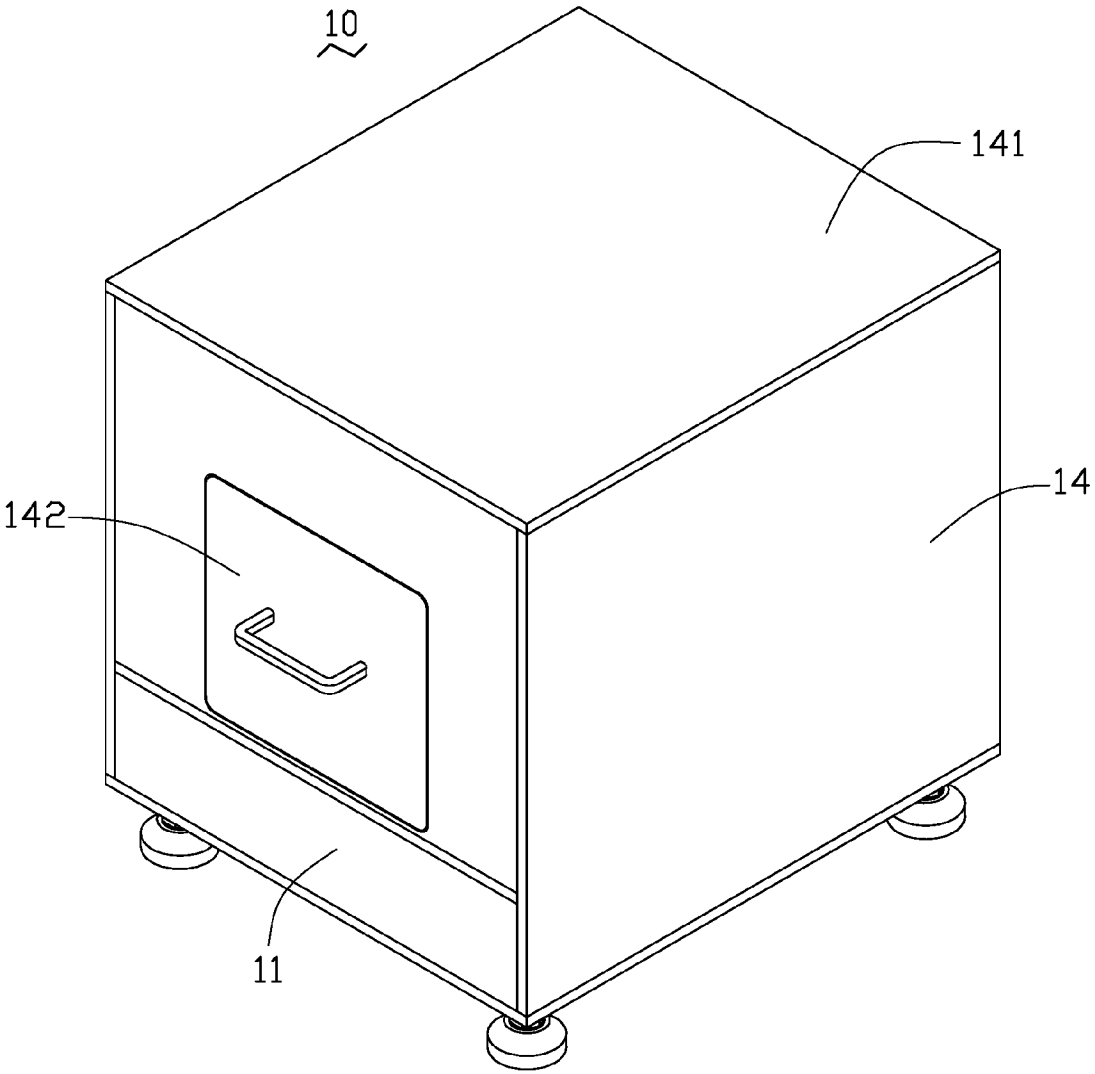
FIG. 5 is an isometric, assembled view of the sound insulating device shown in FIG. 1.
Figure 6:
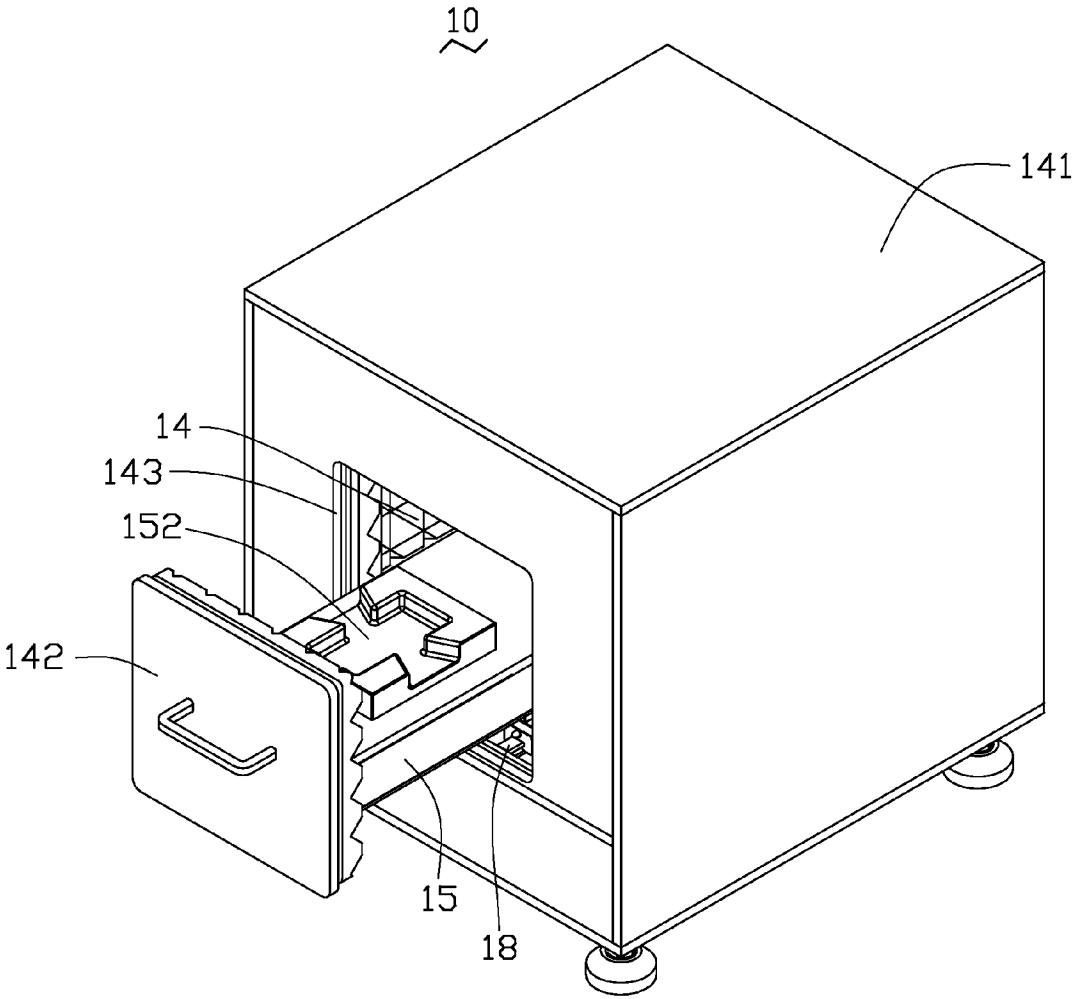
FIG. 6 is an isometric view of the sound insulating device shown in FIG. 1 in use.

Referring to FIGS. 5 and 6, in use, the sound insulating door 142 can be opened to expose the hole 143. The clamping platform 15 moves with the sound insulating door 142 and is exposed to outside of the sound insulating chamber 14. The electronic device requiring audio testing is positioned on the positioning base 152. At this time, the positions of the sound speaker 12 and the sound receiver 13 are respectively adjusted, using the mechanisms described above, to make the sound speaker 12 face the receiver of the electronic device and the sound receiver 13 face the speaker of the electronic device after the electronic device is received into the sound insulating chamber 14 with the clamping platform 15. Thus, a quiet testing environment is achieved because the sound insulating boards 141 and the sound insulating doors 142 block off the outside noises.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of sections within the principles of the invention to the full extent indicated by the broad general meaning of the terms, in which the appended claims are expressed.

What is claimed is:

1. A sound insulating device for carrying out audio testing of an electronic device, comprising:

a sound speaker;

a sound receiver;

a clamping platform configured for clamping the electronic device thereon;

a sound insulating chamber receiving the sound speaker and the sound receiver and the clamping platform therein, the sound insulating chamber being enclosed by sound insulating boards, each sound insulating board including a sound absorbing layer, a cushion layer and an aluminium-alloy layer, the cushion layer arranged between the absorbing layer and the aluminium-alloy layer; and a sound speaker position adjusting mechanism used to adjust the position of the sound speaker, the sound speaker position adjusting mechanism comprising a sliding bar and a connecting pole, one end of the connecting pole fixed to the clamping platform, the other slidably fixed to the sliding bar.

2. The sound insulating device as claimed in claim 1, wherein the sound absorbing layer, the cushion layer and the aluminium-alloy layer are adhered together.

3. The sound insulating device as claimed in claim 1, wherein the sound absorbing layer arranges from about 15 mm to about 25 mm in thickness, the cushion layer ranges from about 5 mm to about 15 mm in thickness, the aluminium-alloy layer arranges from about 15 mm to about 25 mm in thickness.

4. The sound insulating device as claimed in claim 1, including a sound receiver position adjusting mechanism used to adjust the position of the sound receiver.

5. The sound insulating device as claimed in claim 4, wherein the sound receiver position adjusting mechanism includes a sliding board and a first air cylinder, the first air cylinder including a first shaft and a first body, one end of the first shaft is moveably received in the first body, the other fixed to the sound receiver, the first body is moveably mounted to the sliding board.

6. The sound insulating device as claimed in claim 5, further including a clamping platform adjusting mechanism used to adjust the position of the clamping platform.

7. The sound insulating device as claimed in claim 6, wherein the clamping platform adjusting mechanism includes a second air cylinder and a sliding mechanism, the second air cylinder including a second shaft and a second body, one end of the second shaft is moveably received in the second body, the other fixed to the clamping platform, the second body is mounted on the working panel, the sliding mechanism includes two parallel rails and two corresponding guiding slots defined in the body portion of the clamping platform, the rails are slidingly and respectively received in the corresponding guiding slots.

8. The sound insulating device as claimed in claim 7, wherein one of the sound insulating boards defines a hole, the sound insulating device further including a sound insulating door fixed to the clamping board to close or expose the hole, the two rails aligning with the hole.

* * * * *